US005427120A

United States Patent [19]

Wong

[11] Patent Number: 5,427,120

[45] Date of Patent: * Jun. 27, 1995

[54] MODULAR HAIR TREATMENT BRUSH HAVING MULTI-SIDED ROTATABLE MODULES

[76] Inventor: Hilda C. Wong, 14701 Saltamontes Way, Los Altos Hills, Calif. 94022

[ * ] Notice: The portion of the term of this patent subsequent to Aug. 16, 2011 has been disclaimed.

[21] Appl. No.: 116,051

[22] Filed: Sep. 1, 1993

[51] Int. Cl.[6] ..... A45D 24/16

[52] U.S. Cl. ..... 132/120; 132/212; 15/194; 15/202

[58] Field of Search ..... 132/120, 141, 142, 152, 132/153, 154, 208, 212; 15/194, 202

[56] References Cited

U.S. PATENT DOCUMENTS

| | | | |
|---|---|---|---|
| 1,671,334 | 5/1928 | White . | |
| 2,123,043 | 7/1938 | Hertzberg | 132/85 |
| 2,648,082 | 8/1953 | Teetsel | 15/106 |
| 3,349,781 | 10/1967 | Poole et al. | 132/7 |
| 4,368,376 | 1/1983 | Andis | 219/222 |
| 4,932,425 | 6/1990 | Chen | 132/119 |

FOREIGN PATENT DOCUMENTS

| | | | |
|---|---|---|---|
| 996183 | 8/1951 | France | 132/142 |
| 2588459 | 4/1987 | France | 132/212 |
| 309724 | 9/1955 | Switzerland | 132/120 |
| 427663 | 4/1935 | United Kingdom | 132/120 |

*Primary Examiner*—John G. Weiss
*Attorney, Agent, or Firm*—Schneck & McHugh

[57] ABSTRACT

A modular brush for applying hair treatment solution in a quasi-random pattern includes a brush body and a plurality of removable rotating bristle modules. The bristle modules have tightly packed bristles that retain different volumes of hair treatment solution, such as dye, after the bristles have been dipped into a supply of the solution. The modules may be arranged to achieve the user-selected pattern of treatment. Movement of the brush causes the bristle modules to rotate, providing a fresh supply of solution to the sections of hair which are contacted by bristles and leaving the sections in their natural color where the sections are between bristle modules or between arrays of bristles on the same module. A locking member can be employed to selectively prevent rotation of the bristle modules. A detent-and-notch arrangement may be used to ensure synchronous rotation of the bristle modules.

19 Claims, 6 Drawing Sheets

MODULAR HAIR TREATMENT BRUSH HAVING MULTI-SIDED ROTATABLE MODULES

TECHNICAL FIELD

The present invention relates generally to hair treatment and more particularly to devices for applying a hair-coloring solution to create light and dark shading patterns.

BACKGROUND ART

Hair coloring is the art of dying selected strands or sections of hair to achieve a desired appearance. Coloring includes a number of variations, such as highlighting, streaking, lowlighting, frosting, tipping and color texturing.

Prior art hair coloring procedures are difficult, cumbersome and limited with respect to results. One such procedure is described in U.S. Pat. No. 3,349,781 to Poole et al. A hair stylist parts the hair of a person into sectors by combing one sector of hair over the top of the person's head. A protective sheet of material is placed adjacent to the lower portion of the sector. A lower layer of hair is combed from the laid-up sector down onto the protective sheet. A brush having a series of spaced tufts of bristles is used to apply spaced parallel streaks of dye to the layer of hair on the protective sheet. A second protective sheet is then placed on the treated layer and a second layer of laid-up hair is combed downwardly onto the second sheet. The brush is again used to form parallel shadings of hair. This is continued for each sector of the person's scalp.

Another known procedure is to place a cap having a number of holes onto the head of a person. Depending upon the desired pattern of hair shading, strands of the person's hair are pulled through the holes in the cap. The exposed strands can then be colored using one shade or several different shades of dye.

A third known procedure of hair treatment providing different shades of hair coloring is to dip a brush into a first shade of dye solution and use the brush to apply the first shade in a random pattern, whereafter the brush is dipped into a second shade of dye solution and is used to apply the second shade between previously dyed areas of hair. This can be repeated for each shade that is desired.

There are a number of disadvantages to use of these procedures. Self-application is difficult, particularly if hair at the back of a person's scalp is to be dyed. At a beauty salon, hair highlighting is time consuming and expensive.

French Patent No. 1588459 to G. Christ describes a hair coloring brush having cylindrical disks that each carry an array of equidistantly spaced tufts of bristles. The bristles in each tuft form a tapering configuration. Typically, the disks are locked in place during use, but the French reference notes that in certain instances the disks could be mobile in terms of rotation on the brush body on which the disks are located. However, there is no indication of how the mobility should be achieved. While the prior art brush may provide an improvement to applying coloring or tinting, the regular pattern of tufts on each disk and the configuration of the bristles in a tuft limit the naturalness of the results. A natural appearance of sun-bleaching is often a goal in the process of coloring a person's hair. Sun-bleaching achieves a somewhat random pattern of highlighting that is difficult to initiate with the type of brush described in the French reference. Moreover, the circular configuration of bristles in a tuft restricts the volume of solution that can be retained by the tuft, since the bristles are caused to flare outwardly, leaving spaces between bristles.

Another method that is even more difficult to practice without the aid of a skilled stylist is one that includes wrapping strands to be dyed with one or more shades of color within an aluminum foil. Regardless of which of the above-described procedures is used, a certain amount of discomfort or unreliability accompanies the process.

It is an object of the present invention to provide a hair treatment brush for applying a solution in a user-selected pattern, wherein the brush facilitates quick and easy self-application with reasonable comfort and with results that provide an appearance of naturalness. It is a further object to provide such a brush that enables the user to simultaneously apply several shades of hair coloring.

SUMMARY OF THE INVENTION

The above objects have been met by a hair coloring-application brush that includes multi-sided bristle modules that are selectively freed for rotation, wherein each rotating multi-sided module creates an alternating pattern of treated and untreated hair. The bristles on each side of a bristle module retain a separate supply of hair coloring that is introduced to a user's hair in a sequence to achieve a quasi-random pattern of hair coloring, since the free rotation of the bristle modules will result in some hair receiving color and some hair being missed, regardless of whether the brush is moved upwardly, downwardly or sideways. The sections of hair that have color added become lighter or darker, depending upon the coloring solution, while the sections of hair that are missed retain their natural color.

The bristle modules may be arranged on the brush to achieve a variety of hair coloring patterns. The exterior of each bristle module has a number of flat surfaces, with bristles extending in equal length from different surfaces. Thus, there is a gap between bristles on a first flat surface and bristles on a second flat surface. Optionally, some of the bristle modules may include one or more blank surfaces, so that gaps between bristles on a bristle module may be increased. Moreover, the bristle modules may be different with respect to area coverage by the bristles on one or all sides. The brush modularity permits positioning bristle tufts according to taste. Blank surfaces on a module, gaps between tufts of bristles, differences in thickness of tufts and the number of tufts in one row of bristles all contribute to create different quasi-random color patterns to approximate natural hair coloring. When the bristle modules are allowed to rotate, hair highlighting is in a "quasi-random pattern," since the user has control over placement of bristle modules and over spacer modules between bristle modules, but the multi-sided bristle modules that freely rotate add a degree of randomness. The resulting quasi-random pattern closely simulates natural sun-bleaching.

The bristle modules and the spacer modules slide onto a cylindrical portion of a brush body. Because the bristles of the multi-sided modules are mounted on flat sides, they can retain a tightly packed relationship along their entirety. Closely tufted bristles can more reliably pick up and maintain a volume of coloring solution. Curvature of surfaces will cause the bristles to flare out, leaving spaces between bristles and limiting the volume of solution that can be retained.

The bristle modules are able to freely rotate on the brush body. A module may have spaces or may be a continuous array of bristles. Dye can be applied to each of the many sides of the brush, whereafter the brush is brought into contact with a person's hair and rolled in any direction selected by the user. The rotating multi-sided bristle modules provide a fresh supply of hair treatment solution as contact is made with the user's hair from one array of bristles to the next.

All of the bristles may receive the same shade of dye, but this is not critical. Different shades may be applied to different bristle modules. For example, one ring of bristles may be used to highlight a person's hair, while an adjacent ring can be used to provide low-lighting, i.e. darkening.

The bristle modules rotate freely, but the bristle modules may be coupled together for synchronous rotation. A detent-and-notch arrangement for adjacent bristle modules or adjacent bristle and spacer modules may be used to achieve synchronous motion.

The modules may be locked to the brush body to prevent relative rotation, when desired. For example, the modules may be collectively reversed on the brush body, so that the detent of an end module mates with a notch in the brush body. Alternatively, a lock member may be a key or a slide device which is moved into place to provide a means of preventing module rotation. The ability to lock the modules enables the brush to form a continuous pattern of uninterrupted color.

The multi-sided brushes may be used with a modular tray that can be selectively resegmented to correspond with the pattern of bristles selected by a user. During the hair coloring procedure, the bristles of the modular brush are inserted into dye-containing segments of the modular tray. The bristle modules are then rolled to ensure that the bristles of each side of the brush receive a quantity of the dye. The closely packed bristles retain a volume of the dye as the brush is removed from the tray.

An advantage of the present invention is that modularity allows the user to construct the brush and to rearrange the device according to tastes and style changes. Moreover, the freely rotatable bristle modules create quasi-random hair highlighting and lowlighting in a relatively fast and easy application, without the need of plastic caps or the need of foil or plastic wraps. A natural-looking highlighting pattern can be achieved by a person having little or no experience.

BEST MODE FOR CARRYING OUT THE INVENTION

Figure 1:
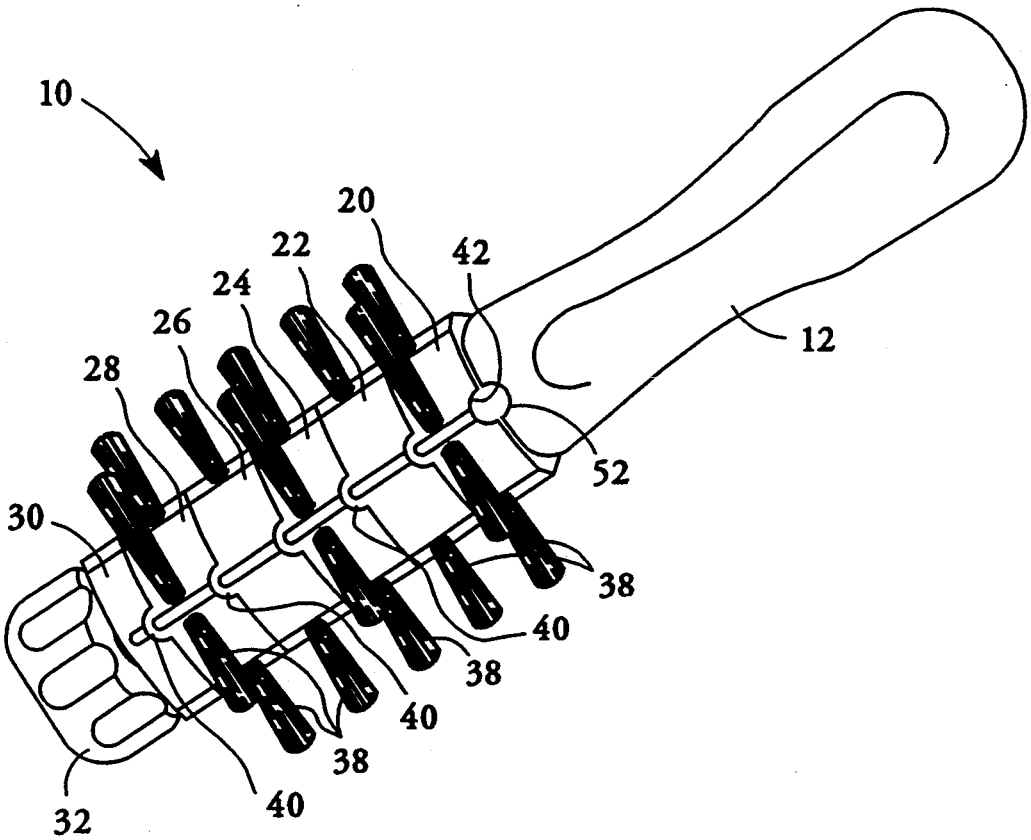
FIG. 1 is a perspective view of a modular brush in accordance with the present invention.
Figure 2A:
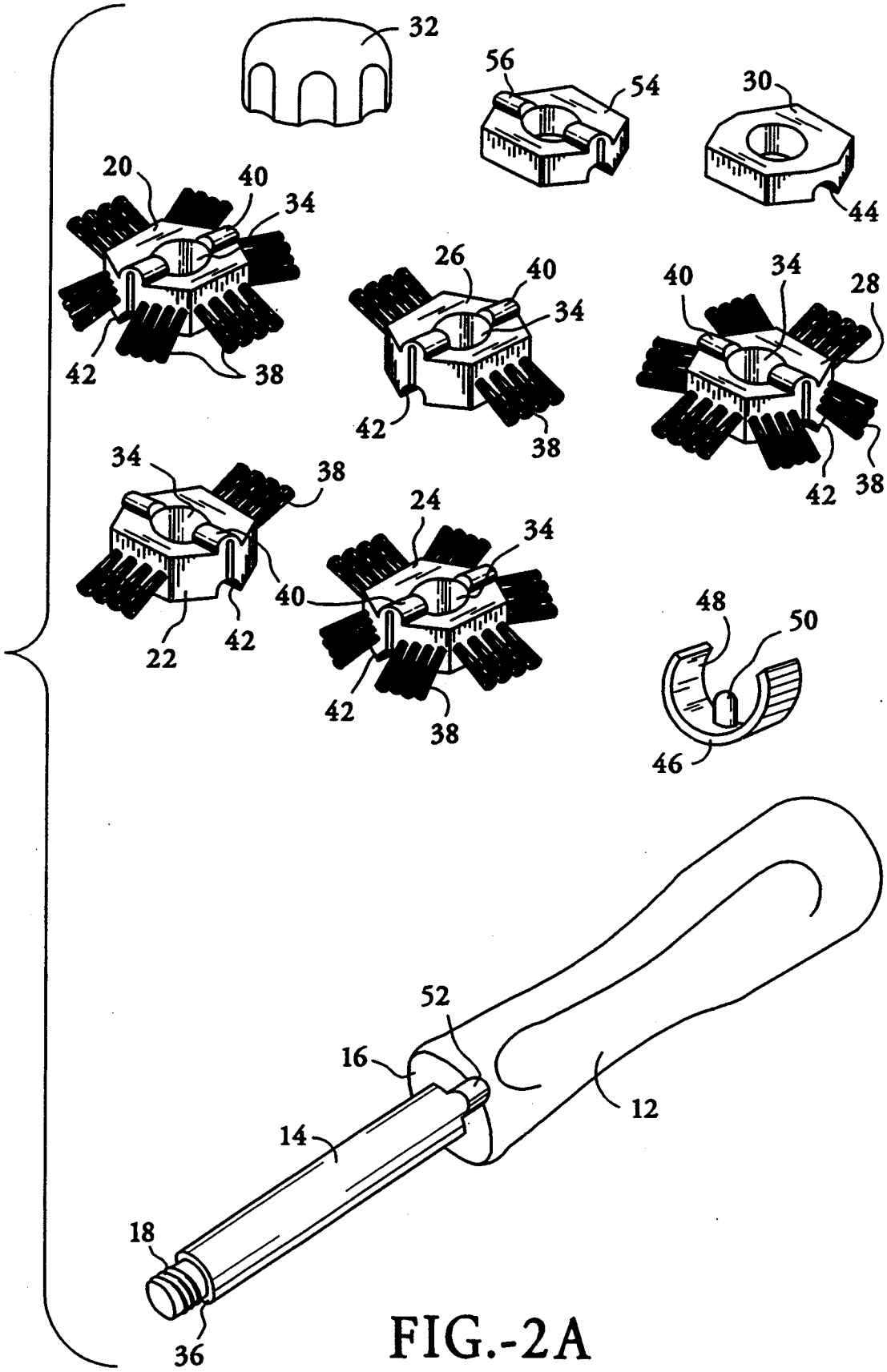
FIG. 2A is a perspective view of components of a modular brush in accordance with the present invention.

With reference to FIGS. 1 and 2A, a modular brush 10 is shown as including a handle 12 and a cylindrical portion 14 extending from the handle. The handle has a configuration to facilitate manipulation by a user, but the configuration of the handle is not critical.

The handle 12 and the cylindrical portion 14 form a brush body. Preferably, the brush body is made of a rigid plastic. The cylindrical portion 14 meets the handle 12 at a shoulder 16. An externally threaded region 18 extends from the cylindrical portion at an end opposite to the handle. FIG. 1 shows five bristle modules 20, 22, 24, 26 and 28. The bristle modules are slidably fit onto the cylindrical portion 14 of the brush 10. Also shown is a washer 30. A cap 32 having an internally threaded bore is fastened to the end of the cylindrical portion to maintain the modules 20–28 and the washer in position.

Each of the bristle modules 20–28 is a structure having six planar exterior surfaces and having an interior bearing surface 34. The inside diameter of the modules is slightly greater than the diameter of the cylindrical portion 14 of the brush body, allowing the modules to freely rotate about the axis of the cylindrical portion. The modules slide onto the cylindrical portion of the brush body to abut the shoulder 16. The end cap 32 is then threaded onto the externally threaded region 18 to fix the modules in place. Preferably, the end cap abuts a shoulder 36 with only a slight distance between the end cap and a collection of the modules 20–28 and washer 30, thereby permitting rotation of the modules while restricting side-to-side sliding of the modules.

Each of the bristle modules 20–28 contains arrays of closely packed bristles 38. The individual bristles of the arrays may be made of nylon. Each array is a collection of tufts and each array acts in the same manner as an absorbent structure for a dripless retention of hair treatment solution. The tufts may be of different number of bristles, extending at equal lengths from the flat sides of the bristle modules, thereby forming different area coverages by the closely packed bristle ends. This creates varying color patterns. A thick bristle tuft will have a larger area coverage and will retain and deposit a greater volume of solution, while thinner tufts will retain and deposit smaller volumes for more subtle color treatment. The six-sided exterior of the bristle modules 20–28 provides a number of flat surfaces for mounting of the arrays of bristles 38. Thus, the bristles are coterminous and are less likely to drip after being dipped in a volume of solution to absorb a portion of the solution.

As noted, the density of the bristles 38 within a tuft and the area coverage at the coterminous outer ends of the bristles will determine the boldness of hair coloring. Suitable tuft holes for bristle modules 20–28 include approximately 0.156 inch diameter holes for wide and bold hair coloring, approximately 0.09 inch diameter holes for medium boldness, and approximately 0.0625 inch diameter holes for tufts that are to achieve fine hair coloring. Because the bristles are on flat surfaces of the modules, the bristles are not caused to flare outwardly from the modules and a desired quantity of solution is obtainable.

While nylon bristles are not critical, the bristle material itself should be non-absorbent, so that dye is easily transferred from the bristles to a user's hair. Moreover, non-absorbent material is more durable and is more easily cleaned, such as by flushing. Bristles having a diameter in the range of 0.01 to 0.012 inch provide sufficient rigidity without being so stiff as to cause discomfort upon contact with the user's scalp. While the bristles 38 are individually non-absorbent, as previously noted the array of bristles is collectively absorbent.

In operation, the brush 10 of FIG. 1 is dipped into a container of hair treatment solution, such as coloring dye. The closely packed arrays of bristles 38 have a density and a material makeup to pick up solution without dripping. The brush is then moved along a user's hair. As each bristle array is rotated into contact with hair, a fresh supply of dye is introduced to the user's hair.

Bristle modules 20, 24 and 28 have arrays of bristles 38 along all six sides of the modules. This arrangement will provide a quasi-random pattern of highlighting or lowlighting that is dense in terms of dyed hair regions. That is, a hit-and-miss hair color pattern is created in which treated sections and untreated sections that retain their natural color are relatively short and closely spaced. In comparison, the other two bristle modules 22 and 26 have planar sides without bristles. Consequently, the closely packed bristles of these two modules will create areas in which the hit-and-miss pattern of coloring comprises relatively short treated sections of hair spaced apart by larger areas in which hair remains untreated. The present invention allows the user to select modules that will achieve a desired quasi-random pattern. Moreover, different shades may be applied simultaneously. For example, a darkening solution can be applied to the bristles of the first bristle module 20, while a lightening solution can be applied to the last bristle module 28.

To selectively increase the control of the quasi-random patterning of equivalent bristle modules, such as the modules 22, 24 and 28 having bristles on each side, a detent-and-notch arrangement is provided for each 10 module. That is, each module 20–28 includes a detent 40 at one end and a notch 42 at the opposite end. When assembled, the detents 40 are received within the notches of adjacent modules, so that the modules rotate synchronously. The washer 30 also includes a notch 44.

Figure 2B:
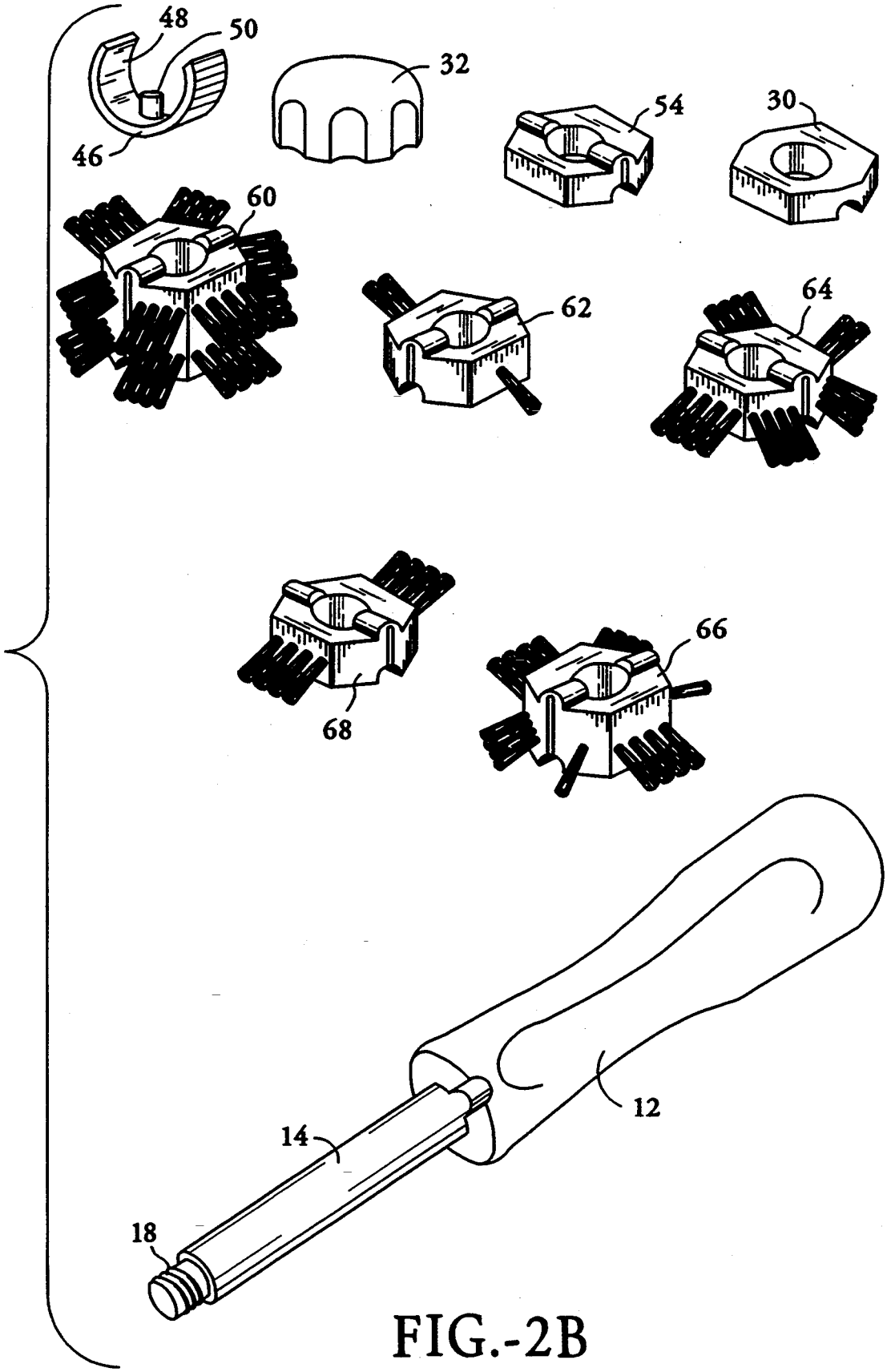
FIG. 2B is a perspective view of a second embodiment of components of a modular brush.

As shown in FIG. 2B, bristle modules 60, 62, 64, 66 and 68 may vary in width to increase the selection of patterns for a user. For example, modules 62, 64 and 68 may have a width of half of module 60 and two-thirds of module 66. In any case, the modules should extend across nearly the entirety of the cylindrical portion 14, so that the modules are prevented from moving from side-to-side during use. While not critical, the cylindrical portion may have a length of approximately 3 inches and the modules may vary in size between 0.5, 0.75 and 1 inch. The washer 30 may have a width of 0.32 inch.

Also shown in FIG. 2A is a lock key 46. The lock key is made of a material and is dimensioned to snap fit to the handle 12 at the area proximate to the shoulder 16. A detent 50 on the lock key extends into a notch 52 in the handle 12 when the lock key is properly positioned along the handle. Turning to FIG. 1, the notch 52 in the handle combines with the notch 42 in the module 20 to form an opening that traps the detent of the lock member. The lock member may be used to quickly and easily prevent rotation of the modules 20–28 for any occasion in which rotation is undesired. The lock key 46 is shown as being snapped in place on the brush 10 in FIG. 3A. Alternatively, the locking mechanism may be a slide member that slides along the handle 12 to partially project into the notch 42 in the end module 20.

Figure 3A:
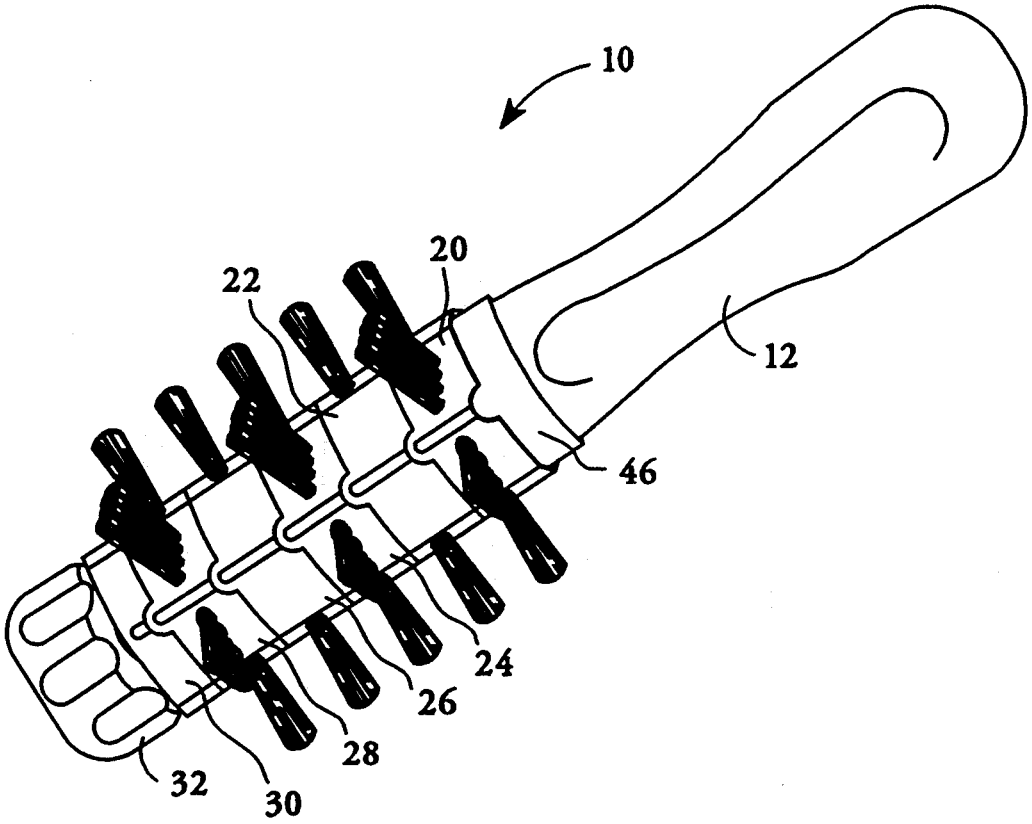
FIGS. 3A and 3B are perspective views of the modular brush of FIG. 1 in a locked mode.

Locking the modules 20–28 in position as shown in FIG. 3A aids a user in creating continuous streaks of color. The modules are assembled and locked in a desired pattern, whereafter hair-treatment solution is applied to the bristles and the locked bristle modules are brought into continuous contact with the hair.

Figure 3B:
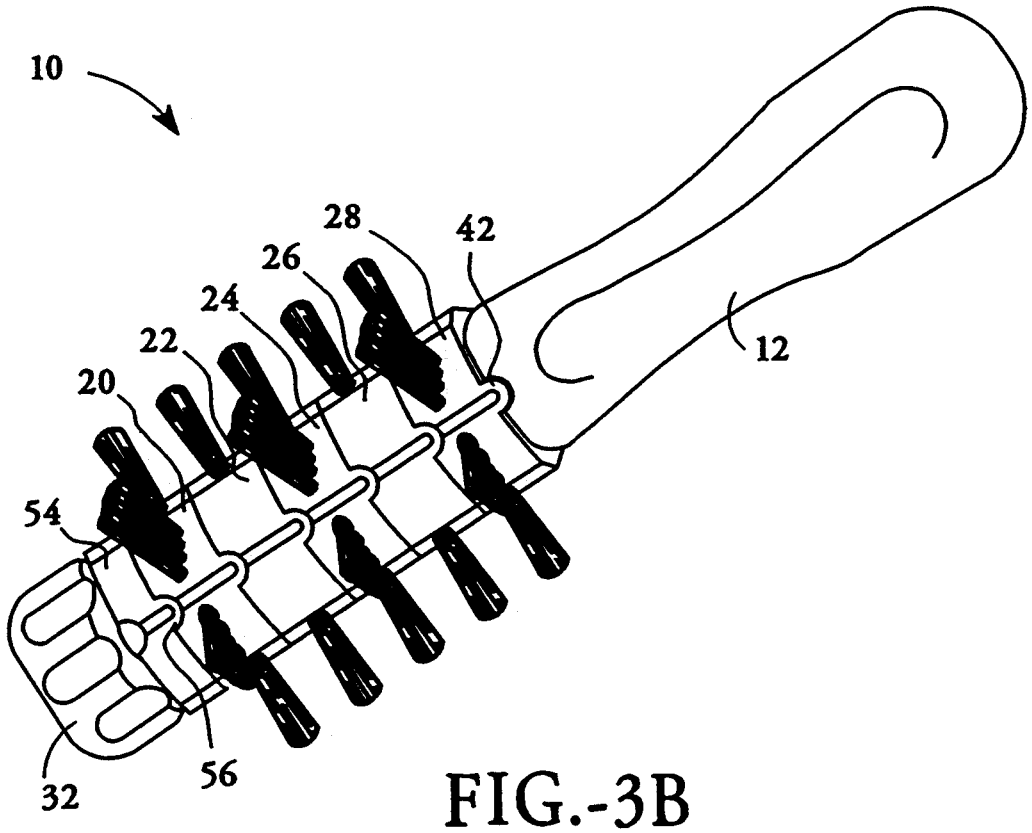

Referring now to FIG. 3B, another method of locking the bristle modules 20–28 to the handle 12 is shown. The direction of the bristle modules has been reversed, so that the module 28 is closest to the handle 12, rather than being closest to the cap 32. In the reverse direction of FIG. 3B, the bristle module 28 has its detent 40 extending into the notch of the handle 12, thereby preventing rotation of the bristle modules.

In FIG. 3B, the washer has been replaced by a spacer module 54. Unlike the washer, the spacer module includes a detent 56 that mates with the notch of bristle module 20 to ensure that the spacer module does not rotate freely while the other modules are locked in position.

Figure 4:
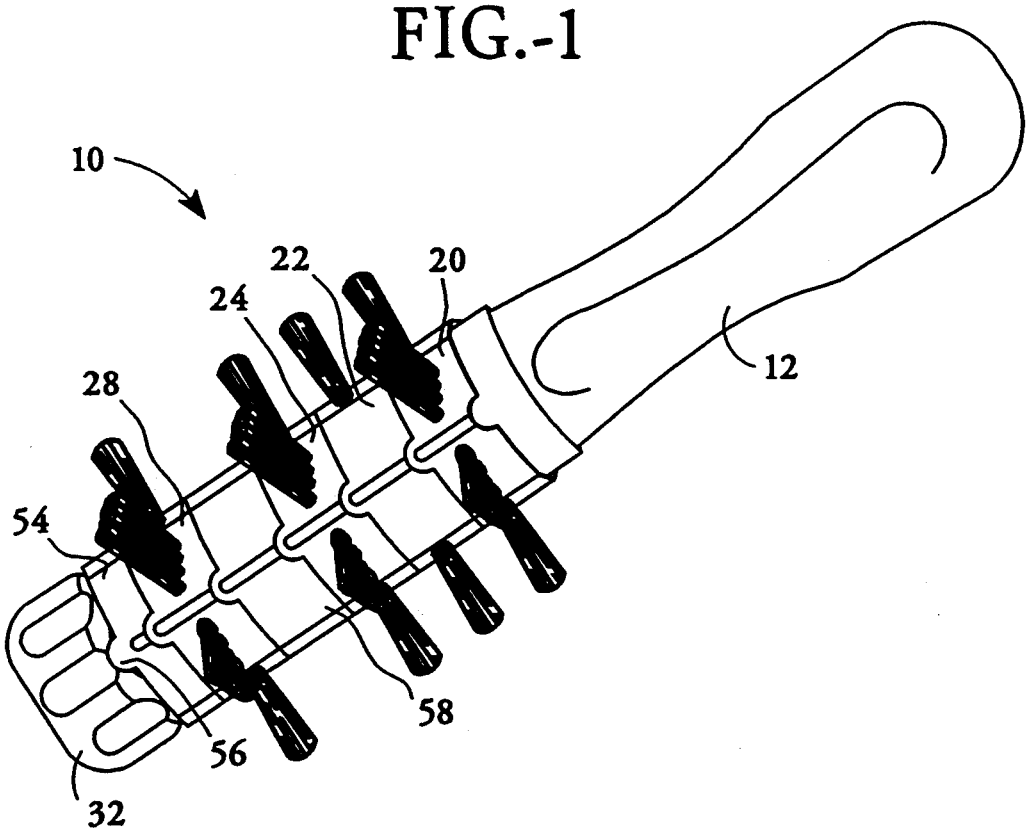
FIG. 4 is a second assembly of the modules of FIG. 2.

A third means for locking the bristle modules in position is shown in FIG. 4. Here, bristle modules 20, 22, 24 and 28 are positioned as in FIG. 1, but a spacer module 58 is now positioned between bristle modules 24 and 28. The use of spacer modules increases the selection of hair treatment patterns available to a user. The spacer modules include the same detent-and-notch arrangement as the bristle modules. In addition to the spacer module 58 between the bristle modules 24 and 28, the thinner spacer module 54 described above is employed. Referring to FIGS. 2A and 4, the detent 56 of the thinner spacer module 54 extends beyond the shoulder 36 to an area adjacent to the externally threaded region 18. Consequently, when the end cap 32 is fastened onto the externally threaded region, the end cap can abut the detent 56 of the spacer module 54. The contact of the end cap with the detent inhibits rotation of the modules 20, 22, 24, 28, 54 and 58.

In operation, the user will typically allow the bristle modules 20, 22, 24 and 28 of FIG. 4 to rotate, creating a roll for quasi-random treatment in which some hair receives solution and some hair is missed. The free rotation of the bristle modules can be accomplished by loosening the end cap 32 out of contact with the detent 56 of the spacer module 54. However, the preferred method of permitting rotation is to replace the spacer module 54 with the washer 30 shown in FIG. 1, since the washer does not include a detent which might act to inadvertently loosen the end cap 32.

Figure 5:
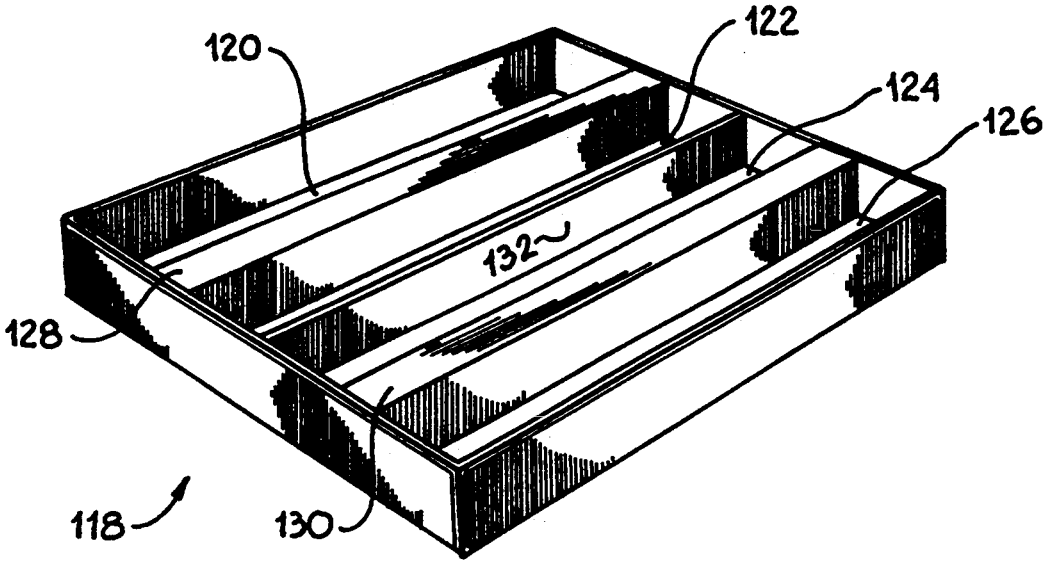
FIG. 5 is a perspective view of a modular dye-retaining tray for use with the brushes of FIGS. 1–4.

Referring now to FIG. 5, a modular tray 118 may be used to provide supplies of dye to the brush described above. Four troughs 120, 122, 124 and 126 may be supplied with a single shade of hair coloring or may each contain different shades. Trough 120 is separated from the adjacent trough 122 by a single step 128. A second step 130 separates troughs 124 and 126. In comparison, a substantially thinner wall 132 separates trough 122 from trough 124.

Figure 6:
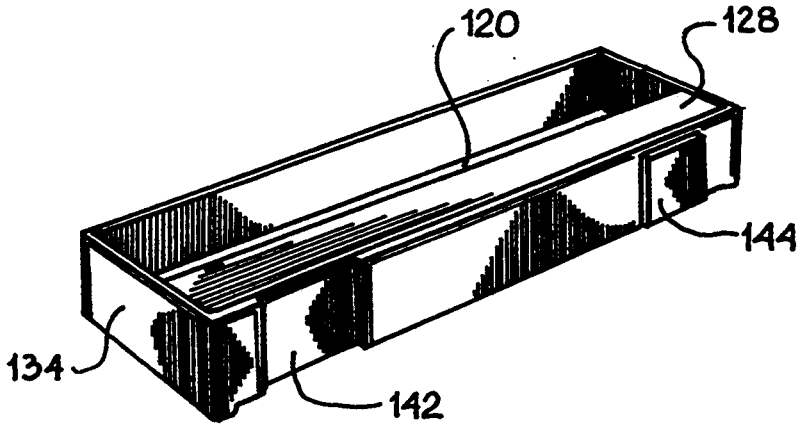
FIGS. 6–8 are perspective views of troughs of the tray of FIG. 5.
Figure 7:
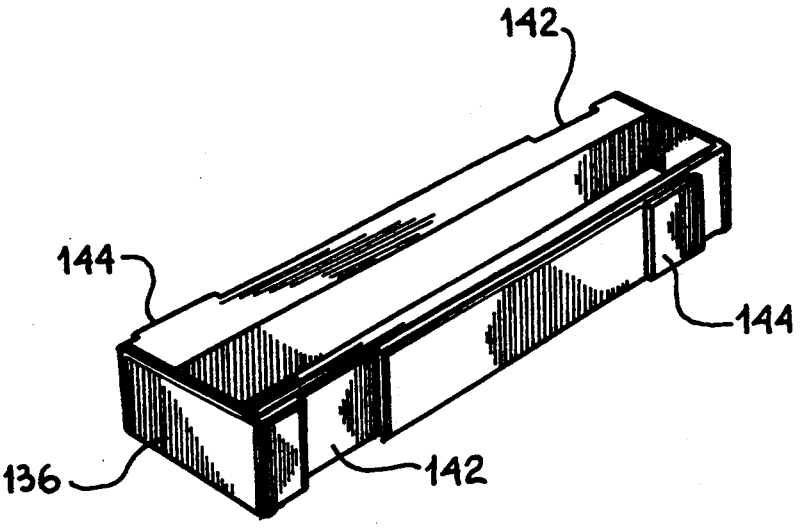
Figure 8:
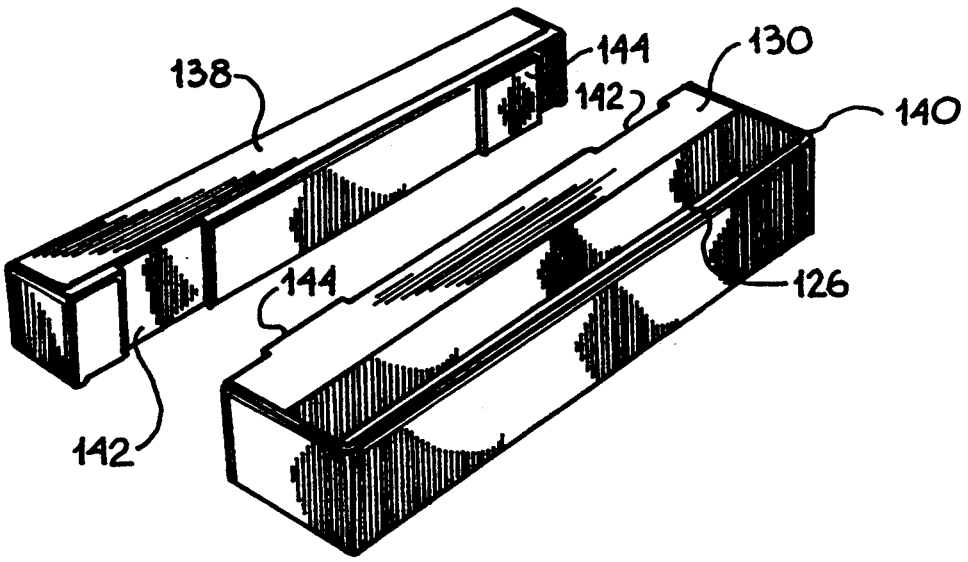

In operation, the user selects a desired hair coloring pattern. The modular brush is then configured to the selected pattern. The next step is to construct the tray 118 to provide troughs 120–126 that correspond to the bristle arrays of the brush. Referring to FIGS. 6–8, segments 134, 136, 138 and 140 may be used to form a modular tray. The segments slide vertically into contact with each other using flanged detents and projections 142 and 144, respectively. The segments may also be connected using means other than the arrangement illustrated in the drawings, such as by fitting a number of troughs and spacers to fit snugly into one large tray. As best shown in FIG. 8, a step segment 138 may be connected to a trough segment 140 having a step 130 in order to provide a wide space between adjacent troughs. The tray 118 is formed to provide troughs that are aligned with bristle patterns on a multi-sided modular brush as described above. The brush is then inserted into the tray and the bristle modules are caused to rotate so that each side receives a quantity of dye. In use, the brush is moved along a person's hair and the modules rotate, so that each side of the brush provides a fresh supply of hair treatment solution.

The type of tray used to retain the supply of hair treatment solution is not critical to the present invention.

I claim:

1. A modular brush for applying hair treatment solution in a quasi-random pattern comprising:

a brush body having an axial shaft; and a plurality of multi-sided bristle modules releasably secured on said axial shaft to allow rearrangement and rotation of said bristle modules on said axial shaft, each bristle module having a plurality of generally flat surfaces arranged to rotate about said axial shaft, at least one generally flat surface of each bristle module having an array of substantially coterminous bristles.

2. The modular brush of claim 1 further comprising displaceable means for selectively locking said bristle modules to prevent rotation.

3. The modular brush of claim 1 wherein each generally flat surface of at least some of said bristle modules has an array of bristles.

4. The modular brush of claim 1 wherein said bristle modules include a first module having bristle arrays of different sizes on different generally flat surfaces.

5. The modular brush of claim 1 further comprising blank modules having an absence of bristles, said blank modules being selectively inserted between said bristle modules to space apart said bristle modules, whereby said modular brush may be employed to form quasi-random patterns of hair treatment solution.

6. The modular brush of claim 1 further comprising means for interconnecting said bristle modules for synchronous rotation about said axial shaft.

7. The modular brush of claim 6 wherein said means for interconnecting includes a detent on each bristle module, said detent disposed to be received in a notch of an adjacent bristle module.

8. The modular brush of claim 1 further comprising a lock key selectively connected to said axial shaft to prevent relative movement between said axial shaft and said bristle modules.

9. The modular brush of claim 8 wherein said lock key is a clip having a detent received within a first notch in said brush body and within a second notch in one of said bristle modules.

10. A modular brush comprising:

a brush body;

a plurality of bristle modules rotatably mounted on said brush body, each bristle module having a multi-sided configuration and having arrays of bristles on a plurality of sides of said configuration; and means for selectively locking said bristle modules on said brush body, said means for selectively locking including a notch-and-detent arrangement on said bristle modules, said notch-and-detent arrangement disposed such that the notch of a first bristle module is selectively aligned with the detent of an adjacent second bristle module for receiving said detent within said notch.

11. The modular brush of claim 10 wherein each bristle module has six sides.

12. The modular brush of claim 10 further comprising spacer modules spacing apart adjacent bristle modules.

13. The modular brush of claim 10 wherein said brush body includes a handle having a notch, said bristle modules including a detent disposed to be selectively received in said notch of said handle to selectively lock said bristle modules.

14. The modular brush of claim 13 wherein said means for selectively locking includes a lock key selectively coupling said brush body to said bristle modules for selectively preventing relative movement therebetween.

15. The modular brush of claim 14 wherein said lock key is snap-fit to said brush body.

16. The modular brush of claim 10 wherein said means for selectively locking includes a cap.

17. A modular brush comprising:

a brush body having a handle portion and a cylindrical portion;

a plurality of bristle modules having an interior bearing surface mounted to said cylindrical portion of said brush body to rotate about the axis of said cylindrical portion, each bristle module having a plurality of exterior surfaces and having a plurality of arrays of bristles, said bristles within an array being substantially coterminous said bristle modules having means for selectively interconnecting said bristle modules for synchronous rotation about said axis;

a spacer module spacing apart adjacent bristle modules; and locking means for selectively preventing rotation of said bristle modules about said cylindrical portion.

18. The modular brush of claim 17 further comprising a cap at an end of said cylindrical portion opposite to said handle portion.

19. The modular brush of claim 17 wherein said means for selectively interconnecting are detent-and-notch arrangements.

* * * * *